US007222942B2

(12) United States Patent
Kawamura

(10) Patent No.: US 7,222,942 B2
(45) Date of Patent: May 29, 2007

(54) WIRING BOARD FOR INKJET HEAD, METHOD OF POLARIZING PIEZOELECTRIC ELEMENTS, AND INKJET RECORDING APPARATUS

(75) Inventor: Kazushige Kawamura, Kaiseimachi (JP)

(73) Assignee: FUJIFILM Corporation, Kanagawa (JP)

( * ) Notice: Subject to any disclaimer, the term of this patent is extended or adjusted under 35 U.S.C. 154(b) by 246 days.

(21) Appl. No.: 10/945,885

(22) Filed: Sep. 22, 2004

(65) Prior Publication Data

US 2005/0062802 A1 Mar. 24, 2005

(30) Foreign Application Priority Data

Sep. 24, 2003 (JP) ..... 2003-332468

(51) Int. Cl.
*B41J 2/14* (2006.01)
*B41J 2/045* (2006.01)
*B41J 2/00* (2006.01)

(52) U.S. Cl. ..... 347/50; 347/68; 347/148

(58) Field of Classification Search ..... 347/50, 347/70–72, 148
See application file for complete search history.

(56) References Cited

U.S. PATENT DOCUMENTS 6,076,914 A 6/2000 Imai
2002/0186278 A1* 12/2002 Nakamura et al. ..... 347/46

FOREIGN PATENT DOCUMENTS

JP 9-323412 A 12/1997
JP 10-86358 A 4/1998
JP 2003-55045 A 2/2003
JP 2003-94648 A 4/2003

* cited by examiner

*Primary Examiner*—Stephen Meier
*Assistant Examiner*—Lisa M. Solomon
(74) *Attorney, Agent, or Firm*—Birch, Stewart, Kolasch & Birch, LLP

(57) ABSTRACT

The wiring board for an inkjet head electrically connected to a piezoelectric element for discharging ink from the inkjet head and installed with a drive element for applying a drive voltage between an individual electrode of said piezoelectric element and a common electrode opposing said individual electrode, comprises a first ground wire which is electrically connected to a ground of said drive element, and a second ground wire which is electrically connected to the common electrode of said piezoelectric element, wherein said first ground wire and said second ground wire are electrically separated.

10 Claims, 8 Drawing Sheets

DURING POLARIZATION OR RE-POLARIZATION

DURING DRIVING

DURING POLARIZATION OR RE-POLARIZATION

DURING DRIVING : 0(V) APPLIED

DURING DRIVING : +(V) APPLIED

RELATED ART

DURING POLARIZATION OR RE-POLARIZATION

DURING DRIVING

RELATED ART

WIRING BOARD FOR INKJET HEAD, METHOD OF POLARIZING PIEZOELECTRIC ELEMENTS, AND INKJET RECORDING APPARATUS

This Nonprovisional application claims priority under 35 U.S.C. § 119(a) on Patent Application No(s). 2003-332468 filed in Japan on Sep. 24, 2003, the entire contents of which are hereby incorporated by reference.

BACKGROUND OF THE INVENTION

1. Field of the Invention

The present invention relates to a wiring board for an inkjet head, a method of polarizing piezoelectric elements, and an inkjet recording apparatus, and more particularly to a wiring board for an inkjet head, a method of polarizing piezoelectric elements, and an inkjet recording apparatus, which are suitable for polarizing piezoelectric elements.

2. Description of the Related Art

FIGS. 9A and 9B are respectively a side view and a plan view of the principal part of a head block comprising a conventional wiring board for an inkjet head.

As shown in FIG. 9B, a wiring pattern for installing upper surface electrodes (individual electrodes) of piezoelectric elements 2 and a drive IC 3, which is a drive element for applying a drive voltage between the electrodes of the piezoelectric elements 2, are formed on a wiring board 1, such as a flexible wiring board.

The lower surface of the wiring board 1 which includes lower surface electrodes of the piezoelectric elements 2 is bonded to a conductive plate (vibration plate) 4, by inserting a thermosetting adhesive, an anisotropic conductive adhesive, or an anisotropic conductive film, between the respective bonding surfaces and then bonding them together by applying heat and pressure. Furthermore, reflow soldering is used to bond the wiring board 1 with the upper surface electrodes (individual electrodes) of the piezoelectric elements 2 and to install the drive IC 3 onto the wiring board 1.

A plate 4 forming a common electrode for the respective piezoelectric elements 2 is electrically connected by soldering to a ground wire 1A of the wiring board 1, via a conductive material or wiring (not illustrated) leading from the lower surface to the upper surface of the piezoelectric element, or the like. Furthermore, in FIG. 9B, numeral 1B denotes a ground wire of the drive IC 3 and GND denotes a common ground terminal of the ground wires 1A and 1B.

The piezoelectric elements have a Curie temperature at which they lose their polarized state. This Curie temperature is different for each type of piezoelectric element.

If heat exceeding the Curie temperature is applied to a piezoelectric element 2, when bonding the piezoelectric elements 2 with the plate 4, bonding the wiring board 1 with the piezoelectric elements 2, or installing the drive IC 3 on the wiring board 1, then the piezoelectric element 2 becomes depolarized and is no longer able to function as an actuator.

Possible solutions for this include a method using piezoelectric elements having a high Curie temperature, or a method where the piezoelectric elements are polarized or re-polarized after being installed on the wiring board.

The former method is described in paragraph "0002" of Japanese Patent Application Publication No. 2003-55045. More specifically, paragraph "0002" states that "If the Curie temperature is high, then the piezoelectric elements have high heat tolerance, and degradation of piezoelectric characteristics due to heat can be restricted, to a relative degree, even if the piezoelectric elements are heated to a high temperature of approximately 200° C. when passed through a solder reflow oven during installation, for example."

On the other hand, if the latter method is adopted, it is necessary to polarize the piezoelectric elements by applying a voltage exceeding the normal operating voltage range to the piezoelectric elements. Therefore, a high voltage is applied to the piezoelectric elements after they have been installed on the wiring board and before the drive IC is installed, in such a manner that a voltage exceeding the voltage tolerance is not applied to the drive IC.

More specifically, as shown in FIG. 10A, after installing a piezoelectric element 2 on the wiring board 1, the piezoelectric element 2 is polarized or re-polarized by applying a polarizing voltage E1 between the terminal IC on the wiring board 1, which is electrically connected to the individual electrode 2A of the piezoelectric element 2, and the ground terminal GND of the wiring board 1 which is electrically connected to the common electrode 2B of the piezoelectric element 2.

A drive IC is then installed on the wiring board 1, as shown in FIG. 10B. In order to drive the piezoelectric element 2, a signal from a drive signal source S is input to the signal input terminal Is of the wiring board 1.

If piezoelectric elements having a high Curie temperature (for example, a Curie temperature of 600° C.–700° C.) as described in Japanese Patent Application Publication No. 2003-55045 are used in order to prevent loss of polarization of the piezoelectric elements during installation on the wiring board, then this reduces the possible range of selection of the piezoelectric elements.

On the other hand, if the piezoelectric elements are polarized or re-polarized after being installed on the wiring board and the drive IC is then installed on the wiring board, then two installation processes are required. Moreover, as shown in FIG. 9A and FIG. 9B, it is desirable that the piezoelectric elements 2 and the drive IC 3 are installed as closely together as possible, but in this case, the heat used during installation of the drive IC 3 also affects the polarized or re-polarized piezoelectric elements 2.

SUMMARY OF THE INVENTION

The present invention is devised with the foregoing in view, an object thereof being to provide a wiring board for an inkjet head, a method of polarizing a piezoelectric element, and an inkjet recording apparatus, which allow the installation steps of installing piezoelectric elements and a drive IC on a wiring board to be completed in one step, and which allow the piezoelectric elements to be polarized or re-polarized after installation, without harming the installed drive IC.

In order to achieve the aforementioned object, the present invention provides a wiring board for an inkjet head electrically connected to a piezoelectric element for discharging ink from the inkjet head and installed with a drive element for applying a drive voltage between an individual electrode of the piezoelectric element and a common electrode opposing the individual electrode, comprising a first ground wire which is electrically connected to a ground of the drive element, and a second ground wire which is electrically connected to the common electrode of the piezoelectric element, wherein the first ground wire and the second ground wire are electrically separated.

In other words, since the first ground wire connected to the ground of the drive element and the second ground wire connected to the common electrode of the piezoelectric element are separated electrically, then it is possible to apply a voltage for polarizing the piezoelectric element between the first and second ground wires. Since this polarizing voltage is not applied to the drive element, no harm is caused to the drive element.

Preferably, in the wiring board for an inkjet head according to the present invention, the drive element has diodes for preventing a reverse bias from being applied to the semiconductor switching elements in the drive element. Thereby, not only is it possible to supply a normal current for driving the piezoelectric element, but furthermore, a polarizing current can also be supplied to the piezoelectric element in order to polarize the piezoelectric element, without applying a reverse bias to the semiconductor switching elements.

Preferably, the wiring board for an inkjet head according to the present invention further comprises a first terminal connected to the first ground wire and a second terminal connected to the second ground wire.

Preferably, the wiring board for an inkjet head according to the present invention is a flexible wiring board.

In order to achieve the aforementioned object, the present invention provides a method of polarizing a piezoelectric elements, comprising a step of polarizing the piezoelectric element by applying a polarizing voltage between the first terminal and second terminal of the wiring board for an inkjet head according to the present invention.

In order to achieve the aforementioned object, the present invention provides a method of polarizing a piezoelectric element, comprising the steps of polarizing the piezoelectric element by applying a polarizing voltage between the first terminal and second terminal of the wiring board for an inkjet head according to the present invention, and shorting the first terminal and second terminal after polarizing the piezoelectric element.

Consequently, the device side connectors, which connect with the connection terminals of the wiring board, and the like, can be used without any modifications.

In order to achieve the aforementioned object, the present invention provides an inkjet recording head manufactured by using the above-described wiring board for an inkjet head.

According to the present invention having the composition described above, the installation of a piezoelectric element and a drive IC on a wiring board can be completed in one installation operation, and a piezoelectric element that has lost its polarization due to the application of a temperature exceeding the Curie temperature in this installation process can be re-polarized, or a piezoelectric element that has not been polarized previously can be polarized, after installation. A voltage equal to or exceeding the voltage tolerance of the drive element is applied to the piezoelectric element during this polarization process, but since it is not applied to the drive element, no harm is caused to the drive element.

DETAILED DESCRIPTION OF THE PREFERRED EMBODIMENTS

Now, detailed description will be made below on the preferred embodiments of the wiring board for inkjet head, method of polarizing piezoelectric elements, and inkjet recording apparatus in the present invention with reference to the accompanying drawings.

General Configuration of an Inkjet Recording Apparatus

Figure 1:
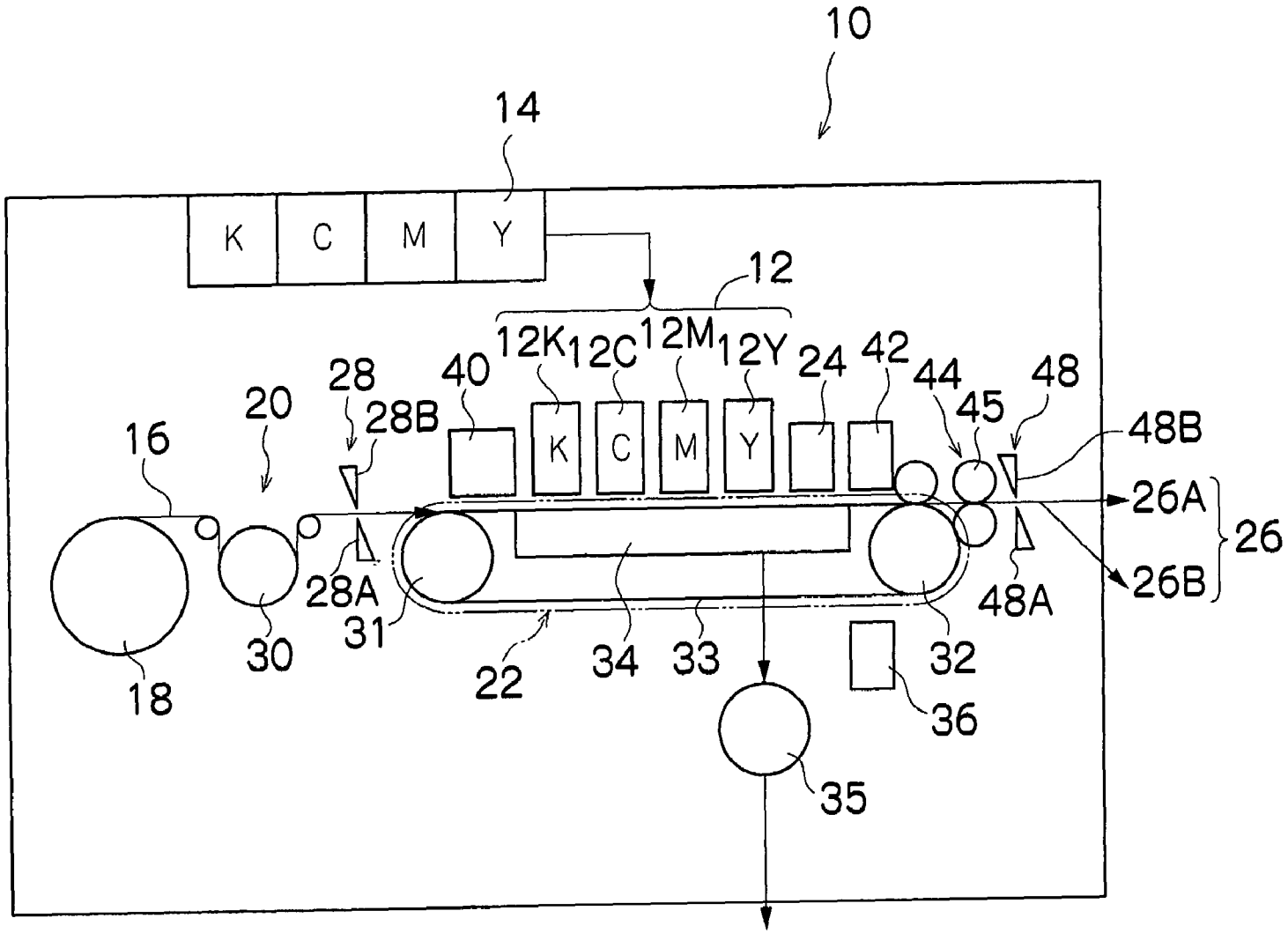
FIG. 1 is a general compositional view showing an inkjet recording apparatus to which an inkjet head according to the present invention is applied.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed perpendicular to a paper conveyance direction (a main scanning direction). Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side along the paper conveyance direction of the recording paper 16 (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26 after cut into a desired size by the cutter 28. Preferably, the target print intended to be printed (in which the desired image is printed) and the test print are output separately. In the inkjet recording apparatus 10, a selection device (not shown) is provided and the selection device switches an output route so that the target print and the test print are sorted and fed to an output unit 26A, 26B, respectively. When the target image and the test print are printed on a large size paper, a cutter (a second cutter) 48 cuts off the test print portion.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 2:
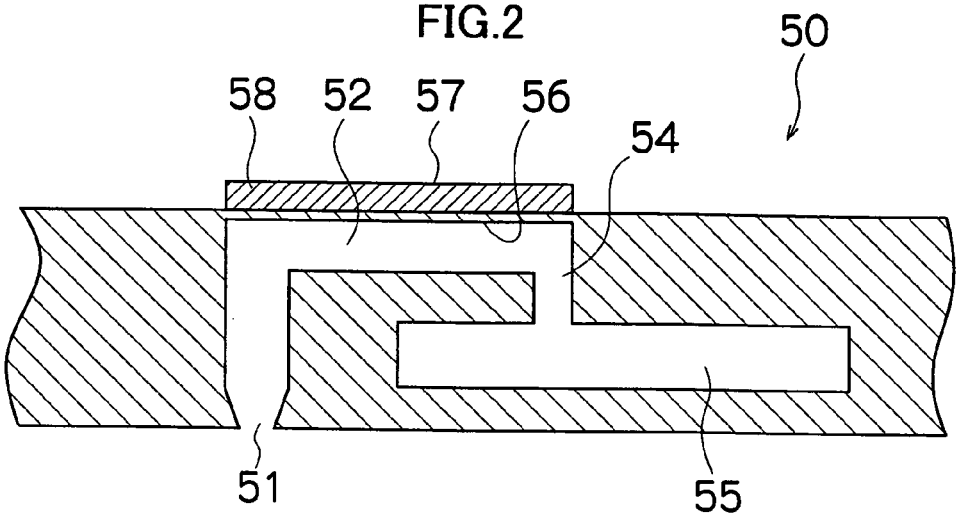
FIG. 2 is a principal cross-sectional diagram showing an example of the composition of a head.

As shown in FIG. 2, the print head 50 in the present embodiment has a structure in which a plurality of ink chamber units including nozzles 51 for ejecting ink-droplets and pressure chambers 52 corresponding to the nozzles 51 are disposed in the form of a staggered matrix, and the effective nozzle pitch is thereby made small.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a ink supply passage 55 through the supply port 54.

A piezoelectric element 58 having an upper surface electrode (a discrete electrode) 57 and a lower surface electrode (not shown) is joined to a plate 56, which forms the ceiling of the pressure chamber 52. The plate 56 is conductive, and it is bonded with the lower surface electrode of the piezoelectric element 58 so as to form an electrical connection between them by a thermosetting adhesive, an anisotropic conductive adhesive, an anisotropic conductive film, or the like, and thereby acts as a common electrode of each piezoelectric element 58 and as a vibration plate to eject ink. The piezoelectric element 58 and the plate 56 are deformed by applying drive voltage between the discrete electrode 57 and the plate 56 used as the common electrode, thereby ink is ejected from the nozzle 51. When ink is ejected, new ink is delivered from the ink supply passage 55 through the supply port 54 to the pressure chamber 52.

(First Embodiment of Wiring Board for Inkjet Head)

Next, a first embodiment of an inkjet head according to the present invention will be described.

Figure 3A:
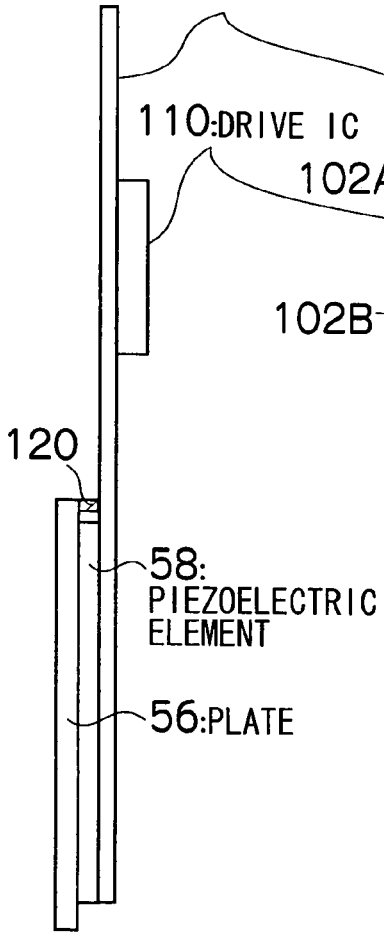
FIGS. 3A and 3B are a side view and a plan view of the principal part of a head block including a wiring board for an inkjet head according to the present invention.
Figure 3B:
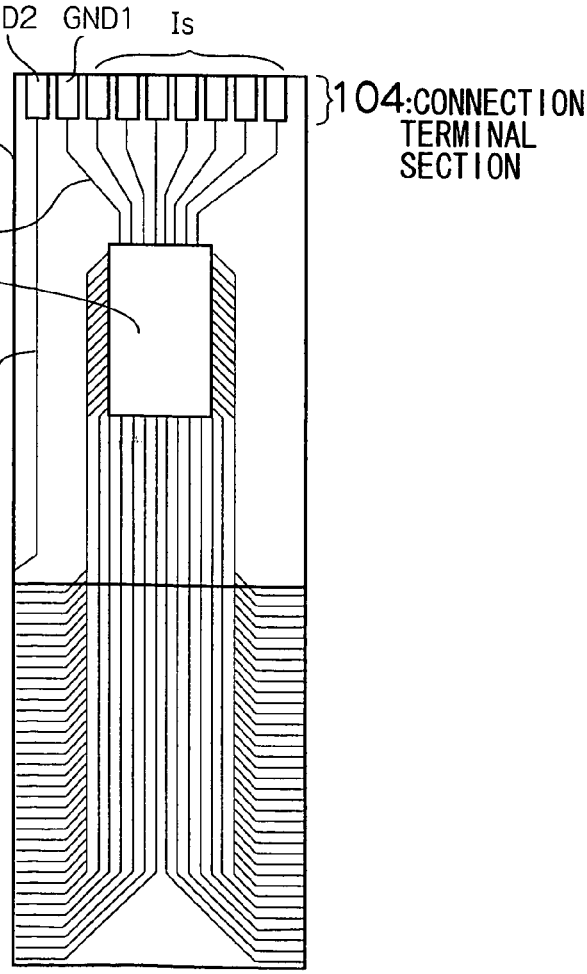

FIGS. 3A and 3B are respectively a side view and a plan view of the principal part of a head block comprising a wiring board for an inkjet head according to the present invention.

In FIGS. 3A and 3B, numeral 100 denotes a wiring board, such as a flexible wiring board. A wiring pattern for installing a drive IC 110, which is a drive element for applying a drive voltage between the individual electrodes of the piezoelectric elements 58, and the common electrode of the piezoelectric elements 58, is formed on the wiring board 100. A plurality of piezoelectric elements 58 are installed on the wiring board 100 for each head block unit, but in order to simplify the description, a single piezoelectric element 58 is taken as a representative example. Furthermore, a full line type head as described with reference to FIG. 1, and the like, may be constituted by arranging a plurality of head blocks.

As shown in FIG. 3B, the wiring pattern in the wiring board 100 includes a ground wire 102A connected electrically to the ground of the drive IC 110, and a ground wire 102B connected electrically to a plate 56 forming a common electrode of the piezoelectric element 58. The connection terminal section 104 of the wiring board 100 is provided with ground terminals GND1 and GND2 connected to the aforementioned ground wires 102A and 102B, and signal input terminals Is to which drive signals are input.

As FIG. 3B reveals, the ground wire 102A and ground terminal GND1 are electrically separated from the ground wire 102B and ground terminal GND2 on the wiring board 100.

Before installing the piezoelectric element 58 on the wiring board 100, firstly, the piezoelectric element 58 and the plate 56 are joined together. The lower surface of the piezoelectric element 58 including the lower surface electrode is bonded with the plate 56 so as to form an electrical connection between them, by introducing a thermosetting adhesive, an anisotropic conductive adhesive, an anisotropic conductive film, or the like, between the piezoelectric element 58 and the plate 56, and then applying heat or heat and pressure.

The piezoelectric element 58 joined to the plate 56, and the drive IC 110, are then installed respectively on the wiring board 100.

In this case, the wiring board 100 and the drive IC 110 are aligned in position and the wiring board 100 and the individual electrode of the piezoelectric element 58 are aligned in position, whereupon the elements are inserted into a reflow oven and heated. Cream solder is previously printed onto the wiring board 100 by means of screen printing, or the like, and when heated in the reflow oven, the cream solder melts and solders the drive IC 110 and the individual electrode of the piezoelectric element 58 to the wiring board 100.

In the reflow oven, the wiring board 100 and other members are heated to a temperature in excess of 200° C. Therefore, if the piezoelectric element 58 has been polarized, these polarization characteristics will be lost. Furthermore, the plate 56 forming the common electrode and the ground wire 102B of the wiring board 100 are electrically connected by soldering, using a conducting material 120, for example, or wiring from the lower surface or the upper surface of the piezoelectric element (not illustrated).

(Method of Polarizing Piezoelectric Element)

Next, the method of polarizing the piezoelectric element 58 will be described.

Figure 4A:
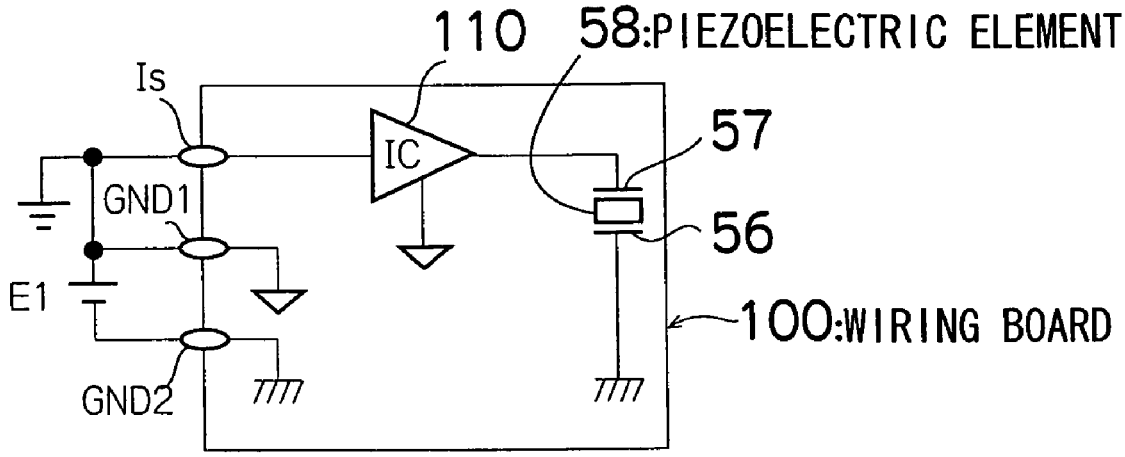
FIGS. 4A and 4B are schematic diagrams of a wiring board after installation of a piezoelectric element and a drive IC.
Figure 4B:
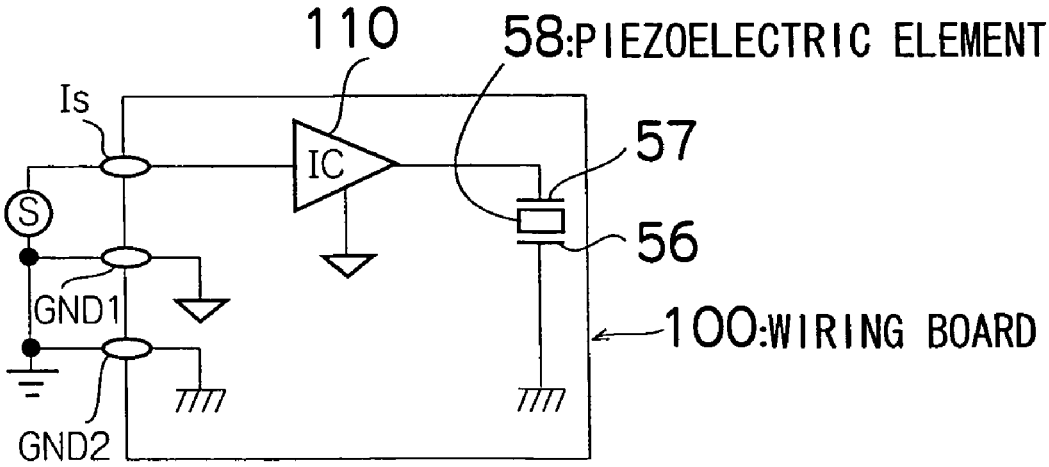

FIGS. 4A and 4B are schematic diagrams of a wiring board 100 after installation of the piezoelectric element 58 and the drive IC 110 shown in FIG. 3A and FIG. 3B.

FIG. 4A shows the state of the connections and the applied voltage when polarizing or re-polarizing the piezoelectric element 58. As FIG. 4A shows, when polarizing or re-polarizing the piezoelectric element 58, a DC power source generating a voltage El for polarizing the piezoelectric element 58 (for example, 70V) is connected between the ground terminal GND 1 connected to the ground of the drive IC 110 in the connection terminal section of the wiring board 100, and the ground terminal GND2 connected to the common electrode of the piezoelectric element 58. By this means, a voltage El is applied between the individual electrode 57 of the piezoelectric element 58, and the plate (common electrode) 56, thereby polarizing the piezoelectric element 58.

In this polarization process, a voltage within the voltage tolerance is applied to the drive IC 110 (a ground level in FIG. 4A), and by implementing protective measures as described hereinafter, the drive IC 110 is prevented from being harmed.

FIG. 4B shows the state of the connections during normal operation. As shown in FIG. 4B, when the piezoelectric element 58 is operating normally, the ground terminals GND1 and GND2 of the wiring board 100 are shorted and the drive signal source S is connected between the signal input terminal Is and the ground terminal GND1. Thereby, a drive signal is input to the drive IC 110, and the piezoelectric element 58 is driven via the drive IC 110.

The ground terminals GND1 and GND2 are shorted by means of a connector which is connected to the connection terminal section 104 of the wiring board 100 (see FIG. 3B), or a circuit board having a connector of this kind.

Figure 5A:
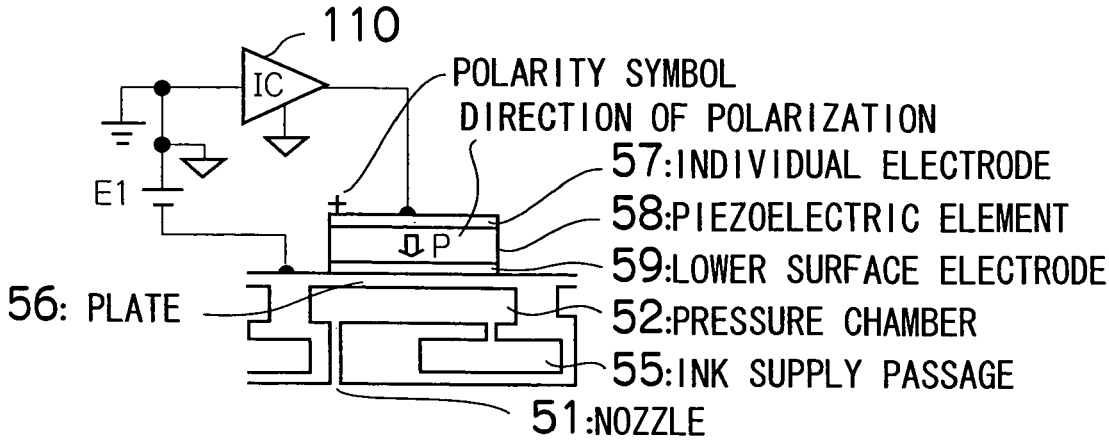
FIGS. 5A, 5B and 5C are principal cross-sectional views of a head block after installation of a piezoelectric element and a drive IC on a wiring board.
Figure 5B:
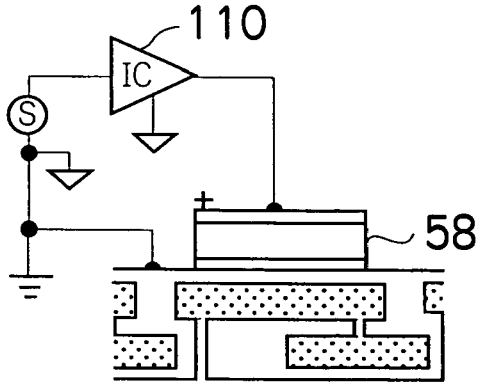
Figure 5C:
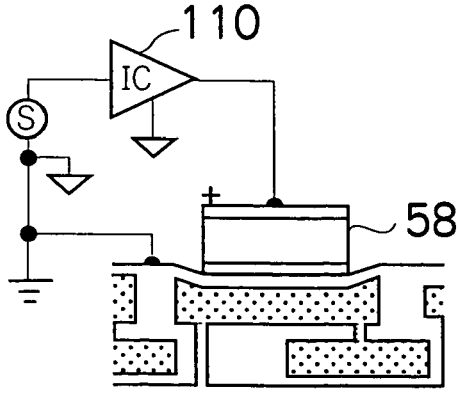

FIGS. 5A, 5B and 5C are principal cross-sectional views of a head block after installation of a piezoelectric element and a drive IC on the wiring board. FIG. 5A corresponds to FIG. 4A, and more specifically, it shows the state of the piezoelectric element 58. The piezoelectric element 58 is polarized by making the connections shown in FIG. 5A and applying a voltage E1 between the individual electrode 57 of the piezoelectric element 58 and the lower surface electrode 59, via the plate 56. In FIG. 5A, arrow P indicates the direction of polarization of the piezoelectric element 58 and the "+" symbol indicates the polarity.

FIGS. 5B and 5C correspond respectively to FIG. 4B, and show the connections and the state of voltage application to the piezoelectric element, during normal operation after polarization or re-polarization. More specifically, FIG. 5B shows a state where 0V is applied to the piezoelectric element 58, and FIG. 5C shows a state where +V is applied to the piezoelectric element 58.

When 0V is applied to the piezoelectric element 58, no electrical field is generated and there is no change in the piezoelectric element 58. On the other hand, when V is applied to the piezoelectric element 58, an electrical field is generated in the direction of polarization P and due to piezoelectric effects, an extension is generated in the piezoelectric element 58 (FIG. 5C). Therefore, the plate 56 deforms together with the piezoelectric element 58 and ink is discharged from the nozzle 51.

Next, the protective measures for the drive IC 110 during polarization of the piezoelectric element 58 will be described.

Figure 6:
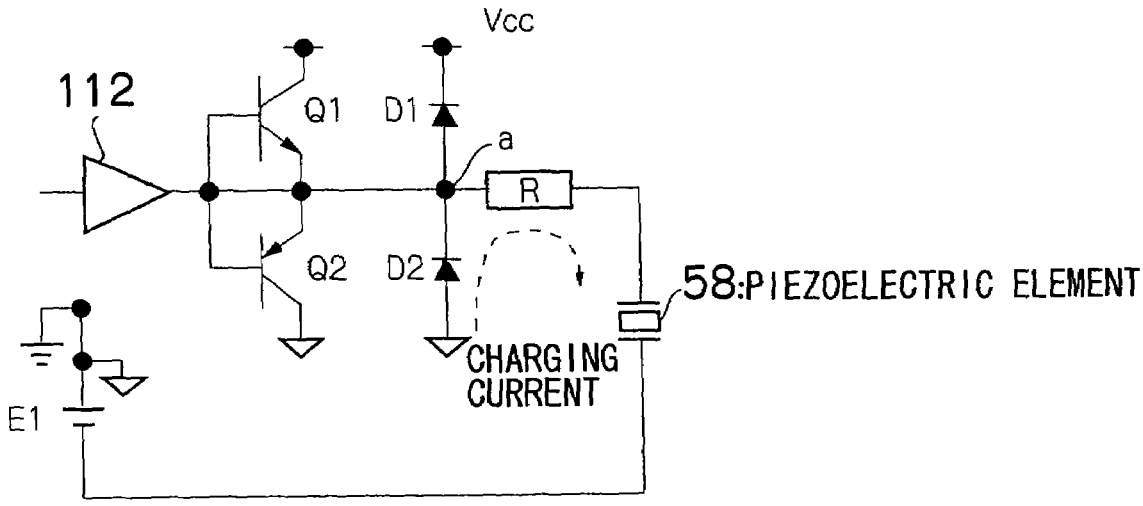
FIG. 6 is a circuit diagram of a principal section, including a drive IC.

FIG. 6 shows a circuit diagram of the principal section including the drive IC 110. FIG. 6 relates to a case where the semiconductor switching elements are transistors.

The drive IC 110 has a buffer 112, transistors Q1 and Q2, diodes D1 and D2, and a resistance R. FIG. 6 shows a circuit for driving one piezoelectric element 58.

In FIG. 6, when a high-level signal is applied from the buffer 112 to the bases of the transistors Q1 and Q2, the transistor Q1 switches on, the transistor Q2 switches off, and a charging current flows to the piezoelectric element 58 via the transistor Q1 and the resistance R. On the other hand, when a low-level signal is applied to the bases of the transistors Q1 and Q2 from the buffer 112, the transistor Q1 switches off, the transistor Q2 switches on, and the electrical charge collected in the piezoelectric element 58, and the like, is discharged to ground via the resistance R and the transistor Q2.

Therefore, in a piezoelectric element 58 which has been polarized and is functioning as an actuator, when a high-level signal is output from the buffer 112, the piezoelectric element 58 deforms, and when a low-level signal is output, it reverts to its original state.

Furthermore, the anode side of the diode D1 and the cathode side of the diode D2 are connected to a junction point a, which connects the transistors Q1 and Q2 with the resistance R. The cathode side of the diode D1 is connected to a power supply voltage Vcc of the drive IC 110, and the anode side of the diode D2 is connected to the ground of the drive IC 110.

Therefore, the diode D1 acts in such a manner that the reverse bias applied to the transistor Q1 escapes into the power supply voltage Vcc, and the diode D2 acts in such a manner that the reverse bias applied to the transistor Q2 escapes as a charging current. In other words, the diodes D1 and D2 respectively act as protective circuits which prevent the transistors Q1 and Q2 from being harmed by the action of the reverse biases.

Here, if a DC power supply having a voltage of E1 is connected between the ground of the drive IC 110 (in other words, the ground terminal GND1 of the wiring board 100) and the ground connected to the common electrode of the piezoelectric element 58 (in other words, the ground terminal GND2 of the wiring board 100), then a charge current flows from the DC power supply and through the piezoelectric element 58 in the direction indicated by the dotted line (in other words, the direction from the ground of the drive IC 110, through the diode D2 and the resistance R, to the piezoelectric element 58). By this means, it is possible to polarize the piezoelectric element 58 by applying a high voltage exceeding the voltage tolerance of the transistors Q1 and Q2 to the piezoelectric element 58, without applying a reverse bias voltage to the transistors Q1 and Q2.

Figure 7:
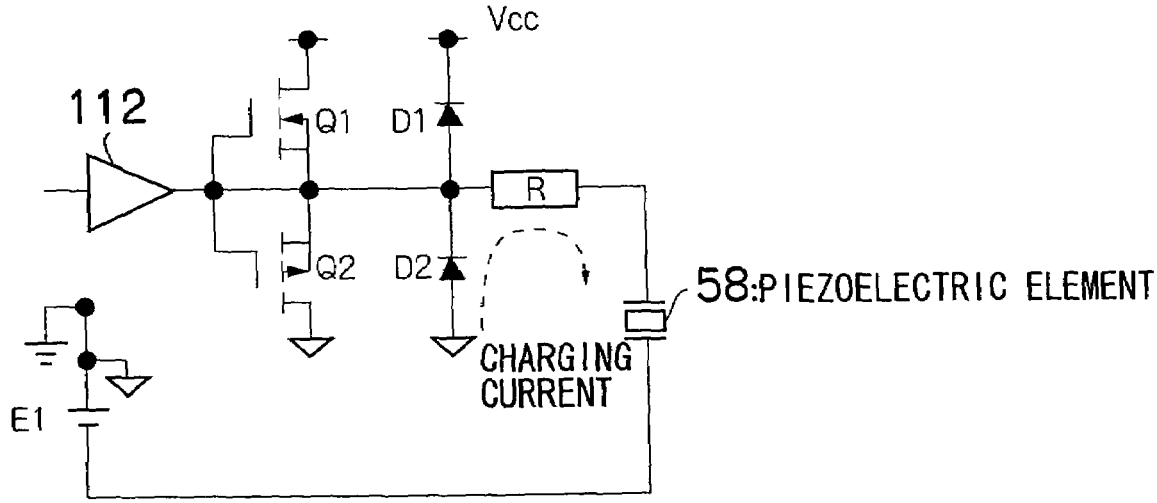
FIG. 7 is a circuit diagram of a principal section, including a drive IC.

FIG. 7 shows a further circuit diagram of the principal section including the drive IC 110. FIG. 7 relates to a case where the semiconductor switching elements are field effect transistors (FET). The FETs Q1 and Q2 illustrated in FIG. 7 differ in type from the transistors (junction transistors) illustrated in FIG. 6, but their action is the same and therefore detailed description thereof is omitted.

(Second Embodiment of Wiring Board for Inkjet Head)

Next, a second embodiment of an inkjet head according to the present invention will be described.

Figure 8A:
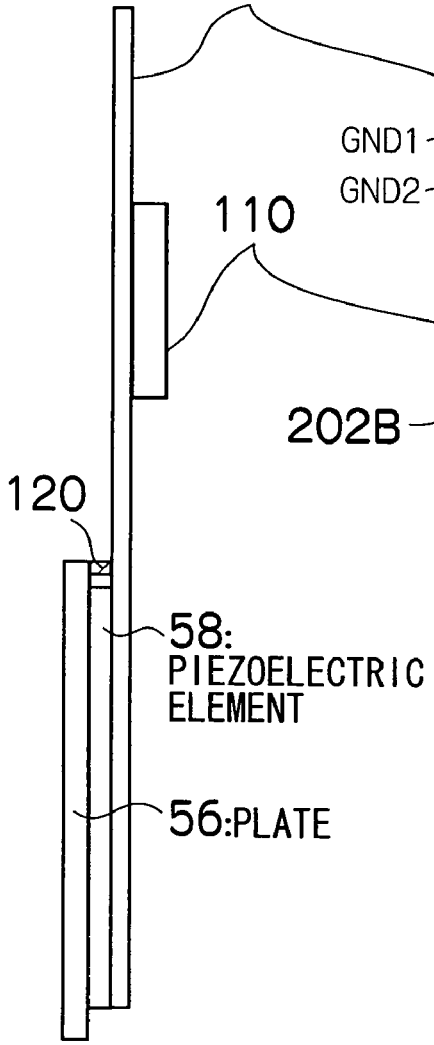
FIGS. 8A and 8B are a side view and a plan view of the principal part of a head block including the wiring board for an inkjet head according to the present invention.
Figure 8B:
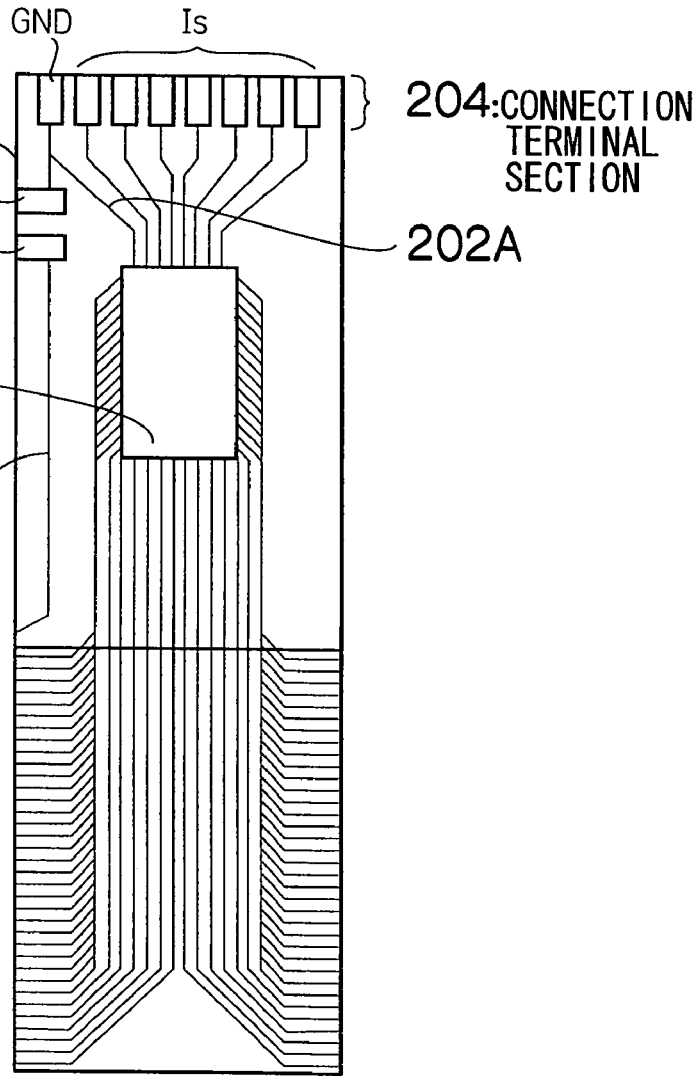

FIGS. 8A and 8B are respectively a side view and a plan view of the principal part of a head block comprising a wiring board for an inkjet head according to the present invention. Parts that are common to those in the first embodiment illustrated in FIGS. 3A and 3B are labeled with the same reference numerals, and detailed description thereof is omitted here.

In FIG. 8A and FIG. 8B, numeral 200 denotes a wiring board, such as a flexible wiring board, and only the wiring board 200 is different from the first embodiment.

The wiring pattern in the wiring board 200 includes a ground wire 202A connected electrically to the ground of the drive IC 110, and a ground wire 202B connected electrically to a plate 56 forming a common electrode of the piezoelectric element 58. Furthermore, a ground terminal GND1 connected electrically to the ground wire 202A and a ground terminal GND2 connected electrically to the ground wire 202B are provided in a separate position to the connection terminal section 204 of the wiring board 200.

The ground terminal GND1 is connected electrically to the ground terminal GND provided in the connection terminal section 204. Furthermore, the ground terminal GND2 is provided in the vicinity of the ground terminal GND1, but it is electrically separated from the ground terminal GND 1.

The piezoelectric element 58 is polarized after installation of the piezoelectric element 58 and the drive IC 110 onto the wiring board 200, by connecting a DC voltage supply between the ground terminals GND1 and GND2, similarly to the first embodiment. After polarization, a zero ohm resistance, for example, is connected electrically between the adjacent ground terminals GND1 and GND2 by soldering, or the like.

Figure 9A:
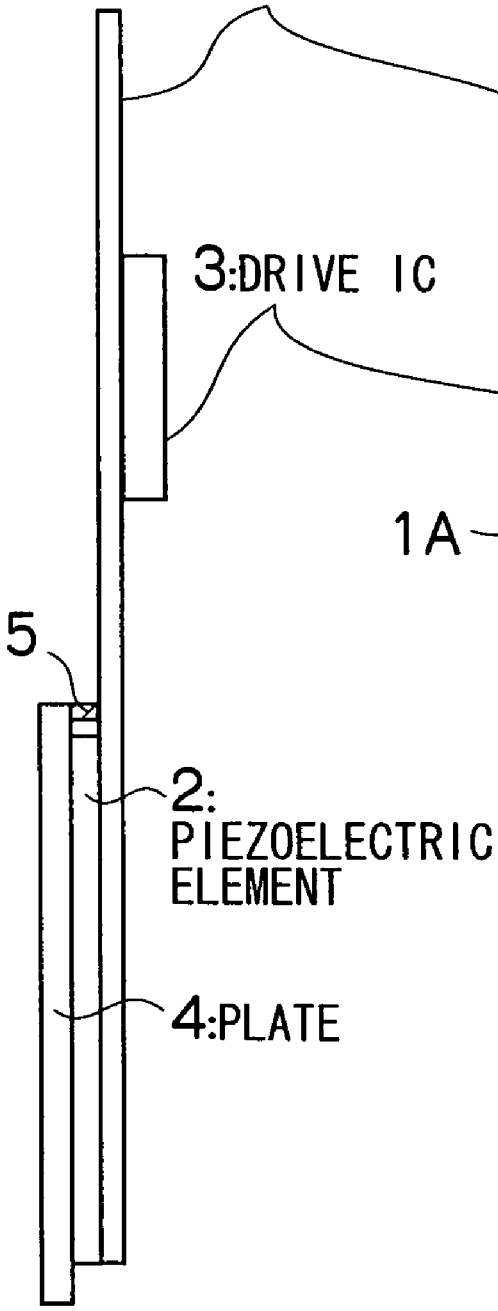
FIGS. 9A and 9B are a side view and a plan view of the principal part of a head block including a conventional wiring board for an inkjet head.
Figure 9B:
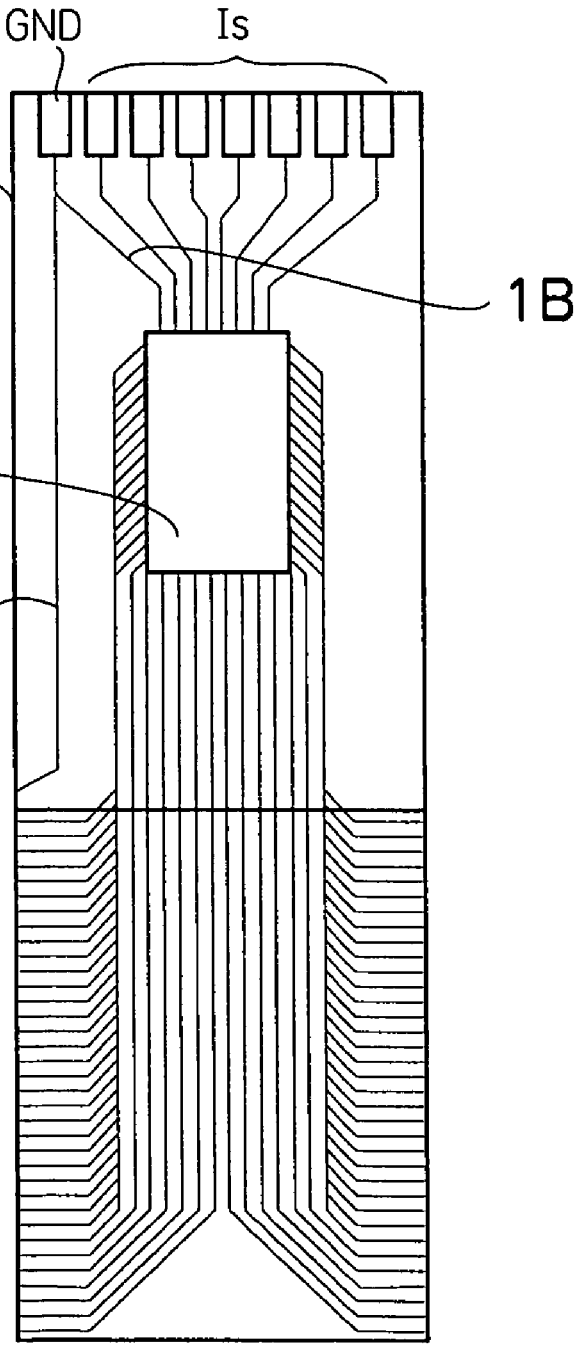
Figure 10A:
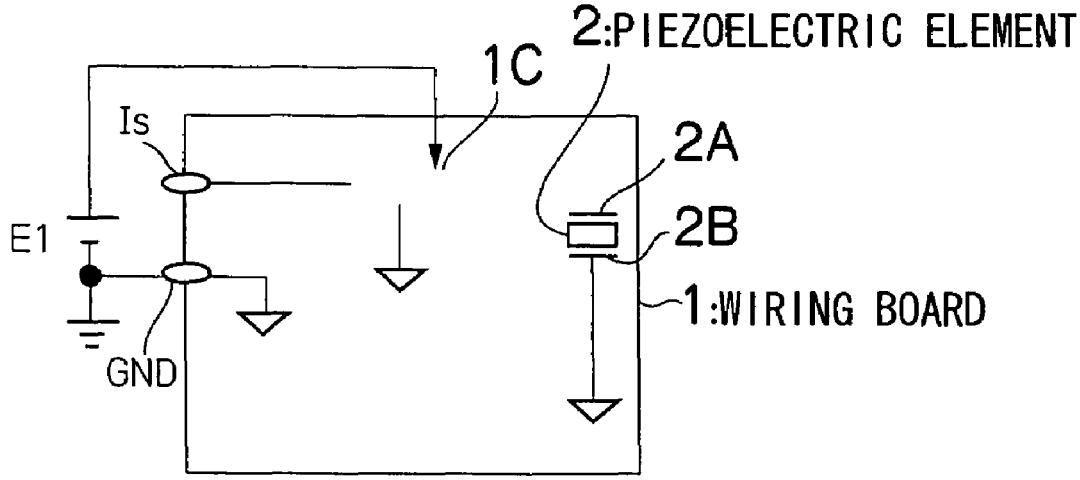
FIGS. 10A and 10B are schematic diagrams of a wiring board for the purpose of describing a conventional method of polarizing a piezoelectric element.
Figure 10B:
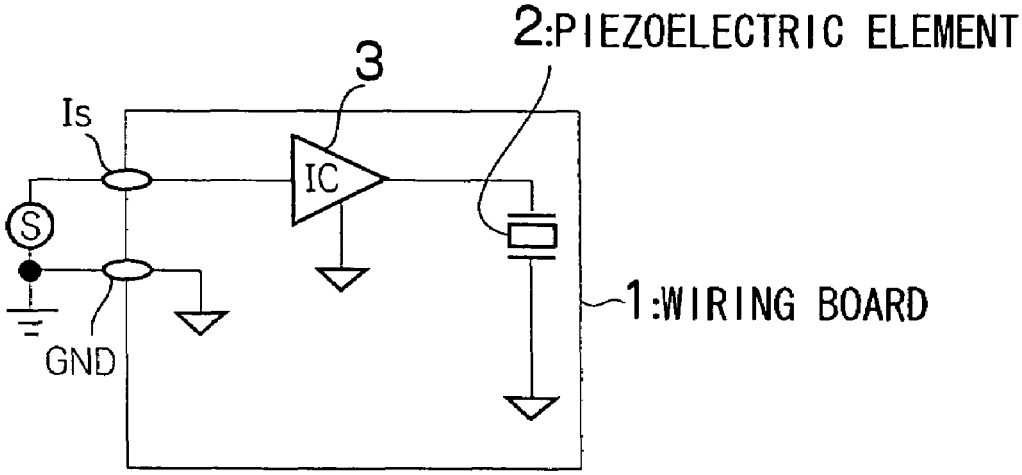

Thereby, the connection terminal section 204 of the wiring board 200 can be formed similar to the conventional shape illustrated in FIG. 9A and FIG. 9B, and hence there is no requirement to change the connectors, board, or the like, to which this connection terminal section 204 is connected.

The wiring board for an inkjet head according to the present invention is not limited to a full line type head as illustrated in FIG. 1, and it may also be applied to a shuttle type head where the head is moved back and forth in a direction orthogonal to the feed direction of the print medium.

What is claimed is:

1. A wiring board for an inkjet head electrically connected to a piezoelectric element for discharging ink from the inkjet head and installed with a drive element for applying a drive voltage between an individual electrode of said piezoelectric element and a common electrode opposing said individual electrode, comprising:

a first ground wire which is electrically connected to a ground of said drive element; and a second ground wire which is electrically connected to the common electrode of said piezoelectric element, wherein said first ground wire and said second ground wire are electrically separated, and said drive element has diodes for preventing a reverse bias from being applied to semiconductor switching elements in the drive element.

2. The wiring board for an inkjet head according to claim 1, further comprising:

a first terminal connected to said first ground wire; and a second terminal connected to said second ground wire.

3. The wiring board for an inkjet head according to claim 2, wherein said wiring board is a flexible wiring board.

4. The wiring board for an inkjet head according to claim 3, wherein the wiring board is provided in an inkjet recording apparatus.

5. A method of polarizing a piezoelectric element, comprising a step of:

polarizing said piezoelectric element by applying a polarizing voltage between the first terminal and second terminal of the wiring board for an inkjet head according to claim 2.

6. A method of polarizing a piezoelectric element, comprising the steps of:

polarizing said piezoelectric element by applying a polarizing voltage between the first terminal and second terminal of the wiring board for an inkjet head according to claim 2; and shorting said first terminal and second terminal after polarizing said piezoelectric element.

7. The wiring board for an inkjet head according to claim 2, wherein the wiring board is provided in an inkjet recording apparatus.

8. The wiring board for an inkjet head according to claim 1, wherein said wiring board is a flexible wiring board.

9. The wiring board for an inkjet head according to claim 8, wherein the wiring board is provided in an inkjet recording apparatus.

10. The wiring board for an inkjet head according to claim 1, wherein the wiring board is provided in an inkjet recording apparatus.

* * * * *